US009340743B2

(12) United States Patent
Sekiguchi et al.

(10) Patent No.: US 9,340,743 B2
(45) Date of Patent: May 17, 2016

(54) METALLURGICAL LUBRICANT POWDER AND METAL POWDER COMPOSITION

(75) Inventors: Hiroki Sekiguchi, Sodegaura (JP); Akihiro Shishikura, Tokyo (JP); Nobuhide Tanino, Ichihara (JP)

(73) Assignee: IDEMITSU KOSAN CO., LTD., Tokyo (JP)

( * ) Notice: Subject to any disclaimer, the term of this patent is extended or adjusted under 35 U.S.C. 154(b) by 741 days.

(21) Appl. No.: 13/638,739

(22) PCT Filed: Mar. 3, 2011

(86) PCT No.: PCT/JP2011/054895

§ 371 (c)(1), (2), (4) Date: Dec. 4, 2012

(87) PCT Pub. No.: WO2011/122230

PCT Pub. Date: Oct. 6, 2011

(65) Prior Publication Data

US 2013/0068069 A1 Mar. 21, 2013

(30) Foreign Application Priority Data

Mar. 31, 2010 (JP) ..... 2010-080980

(51) Int. Cl.

| | |
|---|---|
| ***C10M 129/50*** | (2006.01) |
| ***C10M 129/52*** | (2006.01) |
| ***C10M 105/28*** | (2006.01) |
| ***C10M 105/30*** | (2006.01) |
| ***C10M 105/40*** | (2006.01) |
| ***C10M 169/04*** | (2006.01) |
| *B22F 1/00* | (2006.01) |
| *B22F 3/02* | (2006.01) |

(52) U.S. Cl.

CPC ..... *C10M 129/50* (2013.01); *C10M 105/28* (2013.01); *C10M 105/30* (2013.01); *C10M 105/40* (2013.01); *C10M 129/52* (2013.01); *C10M 169/04* (2013.01); *B22F 2001/0066* (2013.01); *B22F 2003/023* (2013.01); *C10M 2201/041* (2013.01); *C10M 2207/141* (2013.01); *C10M 2207/1403* (2013.01); *C10M 2207/2885* (2013.01); *C10N 2220/082* (2013.01); *C10N 2240/402* (2013.01); *C10N 2240/404* (2013.01); *C10N 2240/58* (2013.01); *C10N 2250/12* (2013.01); *Y10T 428/2982* (2015.01)

(58) Field of Classification Search

CPC ..... C10M 105/28; C10M 105/30; B22F 2601/0066; Y10T 428/2982

USPC ..... 562/467, 473; 560/193; 428/402; 508/506, 517; 75/252

See application file for complete search history.

(56) References Cited

U.S. PATENT DOCUMENTS

| | | | |
|---|---|---|---|
| 5,976,215 | A | 11/1999 | Uenosono et al. |
| 2003/0109388 | A1 | 6/2003 | Hammond |
| 2004/0077508 | A1 | 4/2004 | Hammond |

FOREIGN PATENT DOCUMENTS

| | | | |
|---|---|---|---|
| CN | 1662329 | A | 8/2005 |
| CN | 1910266 | A | 2/2007 |
| CN | 1950161 | A | 4/2007 |
| JP | 4-146972 | A | 5/1992 |
| JP | 7-37239 | A | 2/1995 |
| JP | 11 193404 | | 7/1999 |
| JP | 2000 160206 | | 6/2000 |

OTHER PUBLICATIONS

International Search Report Issued May 31, 2011 in PCT/JP11/54895 Filed Mar. 3, 2011.

Extended European Search Report issued Mar. 18, 2014 in Patent Application No. 11762470.0.

European Office Action issued Apr. 2, 2015 in Patent Application No. 11 762 470.0.

"4-alkoxy benzoic acids" Retrieved from the internet: http://www.molbase.com/en/properties_moldata-53984.html?search_key-word=2493-84-7#tabs, XP55159868, Dec. 23, 2014, pp. 1-3.

Combined Chinese Office Action and Search Report issued May 26, 2014 in Patent Application No. 201180016623.2 (with English translation of the Office Action and English translation of categories of cited documents).

*Primary Examiner* — Sikarl Witherspoon

(74) *Attorney, Agent, or Firm* — Oblon, McClelland, Maier & Neustadt, L.L.P

(57) ABSTRACT

A powder metallurgy lubricant includes an aromatic carboxylic acid represented by a formula (1), $$(Z)n\text{-}Ar\text{—}COOH \quad (1)$$

where Ar represents an aryl group and Z represents a substituent directly bonded to the above aryl group and is one of R, OR, OCOR and COOR, R representing one of an alkyl group, alkenyl group and alkynyl group and n being an integer in a range from 1 to 4. Z may be mutually the same or different when n is 2 or larger.

20 Claims, No Drawings

METALLURGICAL LUBRICANT POWDER AND METAL POWDER COMPOSITION

CROSS REFERENCE TO RELATED APPLICATION

This application is a 371 of PCT/JP2011/054895, filed on Mar. 3, 2011, and claims priority to Japanese Patent Application 2010-080980, filed on March 21, 2010.

TECHNICAL FIELD

The present invention relates to a powder metallurgy lubricant and a metal powder composition containing the lubricant.

BACKGROUND ART

Powder metallurgy is a technique known for manufacturing metal components. The powder metallurgy enables high-precision, high-speed and large-volume production of metal components of complicated shapes without machining. Further, powder metallurgy also enables production of alloys of various compositions only by altering composition ratio of metal powder. Thus, it is expected that powder metallurgy is used for various fields.

In the powder metallurgy, powder of alloy component, graphite and the like are mixed to a main raw material powder in order to enhance physical properties of a sintered body (e.g. strength and processability). The mixture is compacted to form a green compact, which is subsequently sintered to form a product sintered body. At this time, in order to reduce a friction between the powders and between the powder and the mold to enhance compactibility and mold releasing performance of the powder, a molding lubricant such as zinc stearate powder, lithium stearate powder and ethylene-bis-stearamide powder is usually mixed to the above metal powder (see, for instance, Patent Literature 1).

CITATION LIST

Patent Literature

Patent Literature 1 JP-A-11-193404

SUMMARY OF THE INVENTION

Problems to be Solved by the Invention

However, the metal powder using the lubricant disclosed in the related art such as Patent Literature 1 is not sufficient in terms of mold releasing performance from the mold. Further, since the sintering furnace gets dirty after repetition of the powder metallurgy, periodic cleaning of the sintering furnace is required. Thus, it is difficult to increase the production rate and the advantages of powder metallurgy are not fully exhibited.

An object of the invention is to provide a powder metallurgy lubricant that is excellent in mold releasing performance from a mold and is unlikely to pollute a sintering furnace, and a metal powder composition mixed with the lubricant.

Means for Solving the Problems

In order to overcome the above disadvantages, an aspect of the invention provides a powder metallurgy lubricant and a metal powder composition containing the lubricant as follows.

[1] A powder metallurgy lubricant according to an aspect of the invention includes an aromatic carboxylic acid represented by a formula (1) as follows, the aromatic carboxylic acid consisting solely of carbon, hydrogen and oxygen;

$$(Z)n\text{-}Ar\text{—}COOH \quad (1)$$

where Ar represents an aryl group and Z represents a substituent directly bonded to the above aryl group and is one of R, OR, OCOR and COOR, R representing one of an alkyl group, alkenyl group and alkynyl group and n being an integer in a range from 1 to 4. When n is at least 2, Z may be mutually the same or different.)

[2] In the powder metallurgy lubricant according to the above aspect of the invention, R in the formula (1) may have 6 to 24 carbon atoms.

[3] In the powder metallurgy lubricant according to the above aspect of the invention, Ar in the formula (1) may be one of a phenyl group, naphthyl group and biphenyl group.

[4] In the powder metallurgy lubricant according to the above aspect of the invention, Ar in the formula (1) may be a phenyl group.

[5] In the powder metallurgy lubricant according to the above aspect of the invention, n in the formula (1) may be 1 and a substitution site of Z may be at a para position relative to a carboxyl group.

[6] In the powder metallurgy lubricant according to the above aspect of the invention, an average particle diameter of the powder metallurgy lubricant may be at most 30 μm.

[7] A metal powder composition according to another aspect of the invention includes the powder metallurgy lubricant according to the above aspect of the invention.

[8] In the metal powder composition according to the above aspect of the invention, the metal powder composition may include at most 3 mass % of the lubricant based on the total amount of the composition.

[9] The metal powder composition according to the above aspect of the invention may further include a binder; and graphite.

Advantage(s) of the Invention

Since the powder metallurgy lubricant of the above aspect(s) of the invention contains primarily of a predetermined aromatic carboxylic acid consisting of carbon, hydrogen and oxygen, the powder metallurgy lubricant exhibits an excellent mold releasing performance from a mold and is unlikely to pollute a sintering furnace.

DESCRIPTION OF EMBODIMENT(S)

A powder metallurgy lubricant (sometimes referred to as "the present lubricant" hereinafter) according to an exemplary embodiment contains an aromatic carboxylic acid represented by the following formula (1) and consisted only of carbon, hydrogen and oxygen.

$$(Z)n\text{-}Ar\text{—}COOH \quad (1)$$

In the above formula (1), Ar represents an aryl group. Examples of the aryl group include phenyl group, naphthyl group and biphenyl group. Among the above, phenyl group is preferable in terms of enhancing evaporation and decomposition during the sintering process.

Z is a substituent directly bonded to the above aryl group and is one of R, OR, OCOR and COOR. Herein, R is one of an alkyl group, alkenyl group and alkynyl group and may be linear or branched. However, a linear structure is preferable in terms of lubricity. In the substituents, OR or OCOR is preferable.

R is preferably alkyl group in terms of stability of the lubricant. R preferably has 6 to 24 carbon atoms in terms of lubricity and for providing an appropriate melting point.

n is an integer in a range from 1 to 4. When n is 2 or larger, Z may be mutually the same or different.

Further, when Ar is phenyl group and n is 1, a substitution site of Z is at para position relative to the carboxyl group. The present lubricant with the above structure exhibits excellent crystallinity, and high melting point and flowability, and thus is extremely suitable for the powder metallurgy.

The aromatic carboxylic acid represented by the formula (1) preferably accounts for at least 50 mass % of the total amount of the present lubricant, more preferably at least 70 mass % and further preferably at least 90 mass % in terms of the mold releasing performance. It should be understood that the aromatic carboxylic acid of the formula (1) may account for substantially 100 mass % of the present lubricant.

It is preferable that the present lubricant is in the form of powder when being mixed to metal powder in terms of dispersion to the metal powder. Especially, it is preferable that an average particle diameter of the lubricant is at most 30 μm. More preferably, the average particle diameter is at most 15 most preferably at most 5 μm. However, excessively small average particle diameter may entail deterioration of flowability. Accordingly, the average particle diameter is preferably larger than 1 μm.

The average particle diameter can be measured by, for instance, a light scattering method.

Any material generally used for powder metallurgy can be suitably used for the material (e.g. metal) to be used for the metal powder composition of the invention. Examples of such material include iron (in the form of pure iron powder such as atomized iron powder and reduced iron powder), copper, molybdenum, chromium, manganese, nickel, titanium, magnesium, zinc, tungsten, phosphorus and carbon in the form of graphite. These materials are exemplarily used in the form of partially alloyed steel powder, completely alloyed steel powder and a mixture thereof. The known alloyed steel powder include stainless steel such as SUS304 and SUS316.

The metal powder composition of the invention may be a ceramic containing aluminum, boron, magnesium, titanium and the like and can be suitably used for pressure molding. Further, a mixture powder of the above ceramic and metal powder can be used.

The metal powder composition of the invention is provided by mixing the above material powder with the lubricant of the invention. The mixed amount of the lubricant is preferably at least 0.5 mass % based on the total amount of the composition in terms of lubricity (mold releasing performance from a mold). However, since an excessive amount of the lubricant results in a low density of the molded body and consequent reduction in strength, the mixed amount of the lubricant is preferably at most 3 mass %, more preferably at most 2 mass %, further preferably at most 1 mass %.

When the composition is prepared, it is preferable that a binder may further be added. The binder refers to a component for strengthening adhesiveness between graphite and the metal powder (e.g. iron powder). Examples of a suitable binder include: a polymer such as polyethylene, polypropylene, polyethylene ether, polyacrylic ester, polymethacrylic ester, polyamide, polyalkylene glycol, polyvinyl butyral and polyvinyl formal; a higher fatty acid such as stearic acid, oleic acid, myristic acid, palmitic acid and arachidic acid; a higher fatty acid amide such as stearic amide, oleic amide and ethylene-bis-stearoyl amide; and a higher alcohol such as stearyl alcohol and oleyl alcohol.

A powder metallurgy method (molding method) using the powder metallurgy lubricant of the invention exemplarily includes press molding and injection molding. The press molding may be either cold press molding or hot press molding with different mold temperature. The present lubricant may be supplied by being mixed with metal powder to prepare the present composition before being molded or by a mold-lubricating method in which the present lubricant is applied on a mold. In other words, the present lubricant can be applied according to any method.

Further, the present lubricant or the present composition is also applicable to a metal injection molding (MIM method) and the like.

Since the above-described powder metallurgy lubricant of the invention contains primarily a predetermined aromatic carboxylic acid consisting only of carbon, hydrogen and oxygen, the powder metallurgy lubricant improves mold releasing performance after being molded only by being applied on a mold and is unlikely to pollute a sintering furnace. Further, the metal powder composition of the invention provided by mixing the present lubricant also exhibits an excellent mold releasing performance from the mold after being molded and is also unlikely to pollute the mold. Accordingly, with the use of the present lubricant or the present composition, the productivity of the powder metallurgy can be drastically improved.

EXAMPLE(S)

Next, the invention will be described in detail below with reference to Examples. However, it should be understood that the scope of the invention is by no means limited by these examples.

Example 1

The following 4-hexyloxy benzoate (compound 1, manufactured by TOKYO CHEMICAL INDUSTRY CO., LTD.) was used and the evaluations described later were performed. The results are shown in Table 1.

Incidentally, the lubricant was pulverized by a ball mill before being used and was classified with a sieve of 106 μm mesh (the same applies to the Examples below).

Formula 1

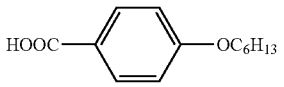

(1) Mold Releasing Performance from a Mold (Lubricity)

(1.1) Friction Coefficient

A friction coefficient was measured with a Bowden-Leben machine under the conditions of: test steel ball of SUJ2 (3/16 inch), test plate of SUS304, 5kg load, speed at 20 m/s, slide distance of 50 mm, slide times of five and test temperature at room temperature (25 degrees C.). Specifically, the lubricant was applied on the test plate and an average of friction coefficients after five sliding movements was obtained.

(1.2) Drawing Force

A flat-plate drawing test was conducted. The flat-plate drawing test was conducted under the conditions of: bead WC, test piece of S45C, 10.8 kN load, slide speed at 500 mm/s, slide distance of 500 mm and test temperature at room temperature (25 degrees C.). Specifically, the lubricant was applied on the test piece and a force (maximum value) required for drawing out the test piece was obtained as the drawing force.

(2) Susceptibility to Pollution

With reference to thermal property (TG-DTA), the degree of pollution to the neighborhood of the molding using the lubricant was briefly evaluated. Specifically, TG/DTA 6200 manufactured by Seiko Instruments Inc. was used as a thermal analysis instrument. After the lubricant was set, the temperature of the lubricant was raised from 50 degrees C. to 500 degrees C. at a rate of 10 degrees C./min under the nitrogen gas flow of 200 mL/min. The softening point and melting point were obtained according to a DTA curve and a 95% decomposition temperature was obtained according to a TG curve. A preferable powder metallurgy lubricant exhibits a low decomposition temperature and does not leave non-volatile residue after being heated.

EXAMPLE 2

After the following 4-octadecyloxy benzoate (compound 2) was synthesized as the powder metallurgy lubricant, the lubricant was evaluated in the same manner as in Example 1. The results are shown in Table 1.

Formula 2

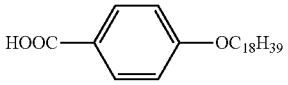

The synthesis of the compound 2 was performed as follows.

49.8 g of 4-hydroxy ethyl benzoate (0.3 mol), 99.9 g of stearyl bromide (0.3 mol), 82.8 g of potassium carbonate and 150 mL of dimethyl formamide were heated for an hour at 120 degrees C.

After being cooled to a room temperature, the mixture was diluted with water. The resultant crystals were obtained by filtration, washed with water and dried at 60 degrees C. under reduced pressure to obtain 123 g of 4-octadecyloxy ethyl benzoate (yield 98%).

110 g of the 4-octadecyloxy ethyl benzoate was added to 220 mL of toluene and was refluxed to be dissolved therein. Then, 220 mL of ethanol was added and a solution dissolving 29.5 g of potassium hydroxide in 30 mL of water was added. Then, the mixture was refluxed for an hour.

After being cooled to a room temperature, 60 mL of concentrated hydrochloric acid was added and 200 mL of water was further added, which was filtered to obtain the resultant crystals. After washing the crystals with water, the crystals were dried at 60 degrees C. under reduced pressure to obtain 98 g of 4-octadecyloxy benzoate (compound 2) (yield 95%).

EXAMPLE 3

After the following 6-octadecyloxy-2-naphthoate (compound 3) was synthesized as the powder metallurgy lubricant, the lubricant was evaluated in the same manner as in Example 1. The results are shown in Table 1.

Formula 3

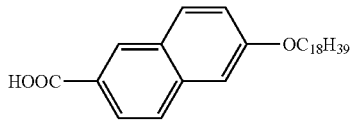

The compound 3 was synthesized in the same manner as the compound 2 except for the use of 6-hydroxy-2-methylnaphtoate in place of 4-hydroxy ethyl benzoate.

EXAMPLE 4

After the following 4-decanoyloxy benzoate (compound 4) was synthesized as the powder metallurgy lubricant, the lubricant was evaluated in the same manner as in Example 1. The results are shown in Table 1.

Formula 4

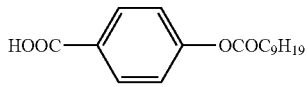

The synthesis of the compound 4 was performed as follows.

30.3 g of decanoic acid chloride (0.1 mol) was slowly added to 13.8g of 4-hydroxy ethyl benzoate (0.1 mol), 140 mL of THF and 22.2g of triethyl amine (0.22 mol). After agitating for thirty minutes at a room temperature, the mixture was refluxed for two hours.

After cooling to a room temperature, 5% hydrochloric acid solution was added until pH became 1. After filtering and washing with water, the generated deposits were dried at 60 degrees C. under reduced pressure to obtain 36.9g of colorless crystals (compound 4) (yield 91%).

EXAMPLE 5

After the following 3-methoxy-4-octadeccanoyloxy benzoate (compound 5) was synthesized as the powder metallurgy lubricant, the lubricant was evaluated in the same manner as in Example 1. The results are shown in Table 1.

Formula 5

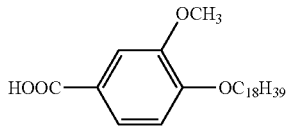

The compound 5 was synthesized in the same manner as the compound 2 except for the use of 3-methoxy-4-hydroxybenzoate in place of 4-hydroxy methyl benzoate.

EXAMPLE 6

After the following 3-octadecanoyloxy benzoate (compound 6) was synthesized as the powder metallurgy lubricant, the lubricant was evaluated in the same manner as in Example 1. The results are shown in Table 1.

Formula 6

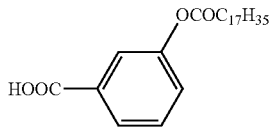

The compound 6 was synthesized in the same manner as the compound 4 except for the use of 3-hydroxy methyl benzoate in place of 4-hydroxy methyl benzoate and the use of stearic acid chloride in place of decanoic acid chloride.

Comparative 1

Kenolube P11 manufactured by Höganäs AB was used as the powder metallurgy lubricant and the same evaluations as in Example 1 were performed. The results are shown in Table 1. Incidentally, the primary component of Kenolube is ethylene bis-amide.

Comparative 2

ZNS-730 manufactured by Adeka Fine Chemical Co, Ltd. was used as the powder metallurgy lubricant and the same evaluations as in Example 1 were performed. The results are shown in Table 1. Incidentally, the primary component of ZNS-730 is zinc stearate.

TABLE 1

| | Friction Co-efficient | Drawing Force (N) | TG-DTA Softening point (° C.) | TG-DTA Melting Point (° C.) | TG-DTA 95% decom-position tem-pera-ture (° C.) |
|---|---|---|---|---|---|
| Ex. 1 (compound 1) | 0.100 | 2890 | 92 | 127 | 260 |
| Ex. 2 (compound 2) | 0.090 | 3280 | 105 | 130 | 384 |
| Ex. 3 (compound 3) | 0.115 | 3110 | 112 | 160 | 443 |
| Ex. 4 (compound 4) | 0.071 | 3530 | 110 | 141 | >500 |
| Ex. 5 (compound 5) | 0.081 | 2860 | — | 113 | 390 |
| Ex. 6 (compound 6) | 0.116 | 3530 | — | 97 | >500 |
| Comp. 1 (Kenolube) | 0.136 | 3600 | 100 | 135 | 491 |
| Comp. 2 (ZNS-730) | 0.108 | 3700 | — | 146 | >500 |

Evaluation Results

As can be seen from the results shown in Table 1, the lubricants of Examples 1 to 6 exhibited favorable mold releasing performance (lubricity). Further, it can be readily understood that, since each of these lubricants is provided by a compound consisting solely of carbon, oxygen and hydrogen, the lubricants do not remain in an article after being sintered and cause no pollution in the sintering furnace.

On the other hand, Kenolube of Comparative 1 exhibited high friction coefficients and drawing force and was inferior in mold releasing performance (lubricity). Further, since the primary component of ZNS-730 of Comparative 2 is zinc stearate, the sintering furnace may be polluted during sintering.

Pilot Test

A pilot test was performed for the compound 2 in the above-described Example 2 as well as the lubricant according to Comparatives 1 and 2. The compound 2 was pulverized with a jet mill so that an average particle diameter of the compound 2 became 3 μm before being used.

0.7 mass % of the lubricant was added to 96.4 mass % of stainless steel powder for powder metallurgy (corresponding to DAP304L manufactured by Daido Steel Co., Ltd.) and 2.9 mass % of electrolyte copper powder (corresponding to CE-25 manufactured by FUKUDA METAL FOIL & POWDER Co., LTD.), which was mixed using a V-mixer.

The mixed powder was molded into a door latch component using a mechanical powder press so that the density of the molding became 6.5 g/cm$^3$ (mass of each of the moldings was 41.45 g). The filling height, compression load, deviation of the compression load and workpiece temperature at the time were measured.

Further, after each of the moldings was put into a sintering furnace to be sintered at 1100 degrees C., the appearance of the moldings was observed. The appearance of the molding was evaluated according to the following standards.

A: None of scratch, blemish and crack could be observed.

B: One of scratch, blemish and crack could be observed.

Further, pollution on the sintering furnace was inspected and was evaluated according to the following standards.

A: No deposition (pollution) on the inner surface of the sintering furnace could be observed.

B: Some deposition (pollution) on the inner surface of the sintering furnace could be observed.

The results are shown in Table 2.

TABLE 2

| Lubricant | Filling Height [mm] | Compression Load [kN] | Load Deviation [kN] | Workpiece Temperature [° C.] | Appearance of Molding | Pollution on Sintering Furnace |
|---|---|---|---|---|---|---|
| Ex. 2 (Compound 2) | 38.1-38.2 | 218 | ±4 | 37-44 | A | A |
| Comp. 1 (Kenolube) | 38.9-39.2 | 218 | ±2.5 | 40-46 | A | A |
| Comp. 2 (ZNS-730) | 36.6-36.6 | 215 | ±3.5 | 37-42 | A | B |

Results of Pilot Test

The compound 2 exhibited lower filling height and more favorable flowability than those of Kenolube (lubricant of Comparative 2). Further, the compound exhibited low workpiece temperature and excellent lubricity. In addition, even after the molding was sintered at 1100 degrees C., the appearance of the molding was favorable and no pollution on the sintering furnace could be observed. In contrast, with the use of ZNS-730, zinc oxide bled out during sintering and polluted the sintering furnace.

According to the above results, it can be understood that the compound 2 according to the invention is superior to the lubricants according to Comparatives 1 and 2.

The invention claimed is:

1. A powder metallurgy lubricant comprising an aromatic carboxylic acid represented by a formula (1), the aromatic carboxylic acid consisting of carbon, hydrogen and oxygen, $$(Z)n\text{-}Ar\text{—}COOH \quad (1)$$

where Ar represents an aryl group and Z represents a substituent directly bonded to the aryl group and is one of R, OR, OCOR and COOR, wherein R represents one of an alkyl group, alkenyl group and alkynyl group, and n is an integer of 1 to 4, and when n is 2 or more, plural Z may be the same or different, wherein the powder metallurgy lubricant is in the form of a powder.

2. The powder metallurgy lubricant of claim 1, wherein R in the formula (1) comprises 6 to 24 carbon atoms.

3. The powder metallurgy lubricant of claim 1, wherein Ar in the formula (1) is one of a phenyl group, naphthyl group and biphenyl group.

4. The powder metallurgy lubricant of claim 3, wherein Ar in the formula (1) is a phenyl group.

5. The powder metallurgy lubricant of claim 4, wherein n in the formula (1) is 1 and a substitution site of Z is at a para position relative to a carboxyl group.

6. The powder metallurgy lubricant of claim 1, wherein an average particle diameter of the powder metallurgy lubricant is at most 30 μm.

7. A metal powder composition comprising the powder metallurgy lubricant of claim 1.

8. The metal powder composition of claim 7, wherein the metal powder composition comprises at most 3 mass % of the lubricant based on a total amount of the composition.

9. The metal powder composition, that comprises:

an aromatic carboxylic acid represented by formula (1), the aromatic carboxylic acid consisting of carbon, hydrogen and oxygen, $$(Z)n\text{-}Ar\text{—}COOH \quad (1)$$

where Ar represents an aryl group and Z represents a substituent directly bonded to the aryl group and is one of R, OR, OCOR and COOR, wherein R represents one of an alkyl group, alkeny1 group and alkynyl group, and n is an integer of 1 to 4, and when n is 2 or more, plural Z may be the same or different;

a binder; and graphite.

10. The powder metallurgy lubricant of claim 1, wherein Z is OR.

11. The powder metallurgy lubricant comprising an aromatic carboxylic acid represented by formula (1), the aromatic carboxylic acid consisting of carbon, hydrogen and oxygen, $$(Z)n\text{-}Ar\text{—}COOH \quad (1)$$

wherein Ar represents an aryl group n is an integer of 1 to 4, wherein each Z is OCOOR, and wherein R represents one of an alkyl group, alkenyl group and alkynl group.

12. The powder metallurgy lubricant of claim 1, wherein Z is OR and R is an alkyl group.

13. The powder metallurgy lubricant of claim 1, wherein Z is OCOR and R is an alkyl group.

14. The powder metallurgy lubricant of claim 1, wherein R is an alkyl group.

15. The powder metallurgy lubricant of claim 1, wherein R is linear.

16. The powder metallurgy lubricant of claim 1, wherein R is a linear alkyl group.

17. The powder metallurgy lubricant of claim 1, comprising 50 mass % or more of the aromatic carboxylic acid, based on a total amount of the lubricant.

18. The powder metallurgy lubricant of claim 1, comprising 70 mass % or more of the aromatic carboxylic acid, based on a total amount of the lubricant.

19. The powder metallurgy lubricant of claim 1, comprising 90 mass % or more of the aromatic carboxylic acid, based on a total amount of the lubricant.

20. The powder metallurgy lubricant of claim 1, wherein the aromatic carboxylic acid is represented by a formula selected from the group consisting of:

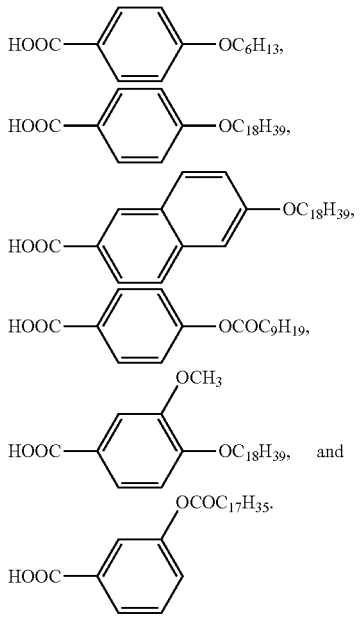

* * * * *